US007654020B2

(12) United States Patent
Frederick

(10) Patent No.: US 7,654,020 B2
(45) Date of Patent: Feb. 2, 2010

(54) GUN GRAFFITI

(76) Inventor: Benjamin Lynn Frederick, 403 E. Herbison, Dewitt, MI (US) 48820

( * ) Notice: Subject to any disclaimer, the term of this patent is extended or adjusted under 35 U.S.C. 154(b) by 244 days.

(21) Appl. No.: 11/442,730

(22) Filed: May 30, 2006

(65) Prior Publication Data

US 2007/0163160 A1 Jul. 19, 2007

Related U.S. Application Data

(60) Provisional application No. 60/759,747, filed on Jan. 19, 2006.

(51) Int. Cl.
*G09F 3/00* (2006.01)

(52) U.S. Cl. ..... 40/306; 40/299.01

(58) Field of Classification Search ..... 40/660, 40/306

See application file for complete search history.

(56) References Cited

U.S. PATENT DOCUMENTS 3,063,184 A * 11/1962 Sukala, Jr. ..... 42/96
3,634,964 A * 1/1972 Nail ..... 446/473
3,787,993 A * 1/1974 Lyon ..... 40/306
4,636,271 A * 1/1987 Gandolfo ..... 156/73.1
4,716,809 A * 1/1988 A'Costa ..... 89/14.3
RE32,752 E * 9/1988 Kiang ..... 42/74
4,922,642 A * 5/1990 Ohlhauser ..... 42/96
5,046,276 A * 9/1991 Morris ..... 42/70.01
5,752,630 A * 5/1998 Guo ..... 222/192
5,850,706 A * 12/1998 Evans ..... 42/96
5,890,308 A * 4/1999 Harrington ..... 40/660
6,129,959 A * 10/2000 Mercer et al. ..... 428/35.5
6,289,616 B1 * 9/2001 Alvern ..... 40/299.01
6,722,073 B2 * 4/2004 Cossio ..... 42/96
6,885,332 B2 * 4/2005 Panek et al. ..... 342/1
6,986,221 B2 * 1/2006 Mullis ..... 42/74

* cited by examiner

*Primary Examiner*—Lesley D Morris
*Assistant Examiner*—Christopher E Veraa
(74) *Attorney, Agent, or Firm*—Woodard, Emhardt, Moriarty, McNett & Henry LLP Patent and Trademark Attorneys

(57) ABSTRACT

Among other things, disclosed is a device with an adhering mechanism and signage that can be placed on a gun, such as a paint ball gun, that can identify the user or a sponsor or advertiser. A thin flat piece of material may be rolled up and its sides connected into a seam, with signage placed on an outside surface, and the material is placed on a gun, e.g. on a gun barrel.

16 Claims, 2 Drawing Sheets

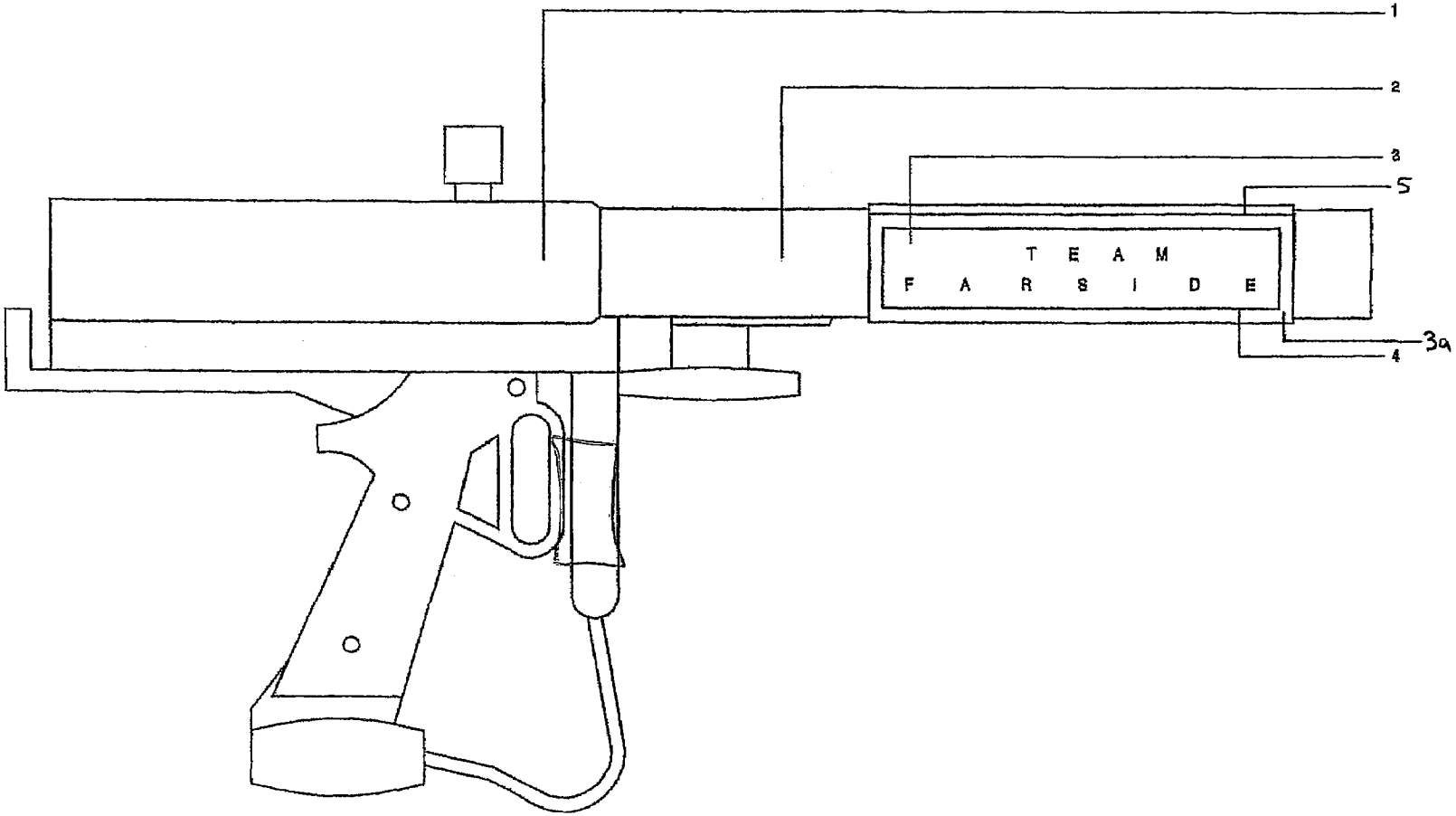
"FIG. 1"

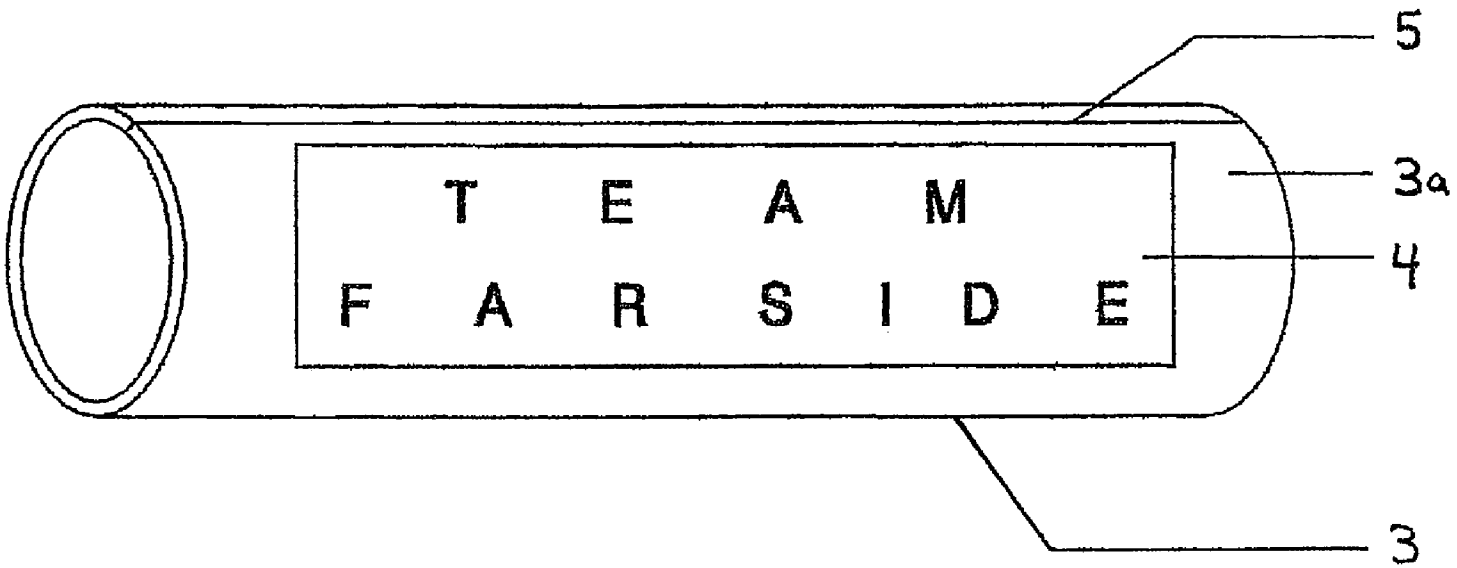
"FIG. 2"

GUN GRAFFITI

CROSS-REFERENCE TO RELATED APPLICATIONS

This application relates to and claims priority from U.S. Provisional Patent Application Ser. No. U.S. 60/759,747 filed on Jan. 19, 2006, the specifications of which are incorporated herein by reference.

FEDERALLY SPONSORED RESEARCH

Not Applicable

SEQUENCE LISTING OR PROGRAM

Not Applicable

FIELD OF INVENTION

This disclosure relates to a way of displaying sponsorship as well as team spirit in the paint ball industry. Moreover, it relates to a cover for the paint ball gun itself.

BACKGROUND OF INVENTION

Paint ball is a fairly new sport which has come on strong in the last few years with teams forming all over the globe. In fact, college teams are now forming and scholarships are being awarded at universities all over the nation for paint ball enthusiasts. While some may call it an extreme sport, it is being recognized as a sport where one who has the talents of precision accuracy with a paint ball gun and speed can make a living at it through such modes as endorsements. This new innovative product will allow for individuals as well as teams to create funds through displaying products for other companies. The new innovative product can also be used to display team logos.

SUMMARY

In accordance with the present disclosure, a gun-barrel cover is comprised of a material that may have elastic properties, including but not limited to an adhering mechanism and logos, names, or other signage or visual identification on, connected to or adhered to the adhering mechanism. In certain embodiments, the adhering mechanism can be a soft or soft-sided material, and as already noted may be elastic. The signage may be printed on a number of fabrics such as cotton, polyester and blends of those materials, or placed or displayed on the material in other ways.

Accordingly, besides the objects and advantages as described in my above-noted patent application, several objects and advantages of the present invention are:

(a) "Gun Graffiti" will allow for more advertisement area within the paint ball industry.

(b) "Gun Graffiti" will allow for athletes to stand out from the crowd and be unique.

(c) "Gun Graffiti" provides all levels of markers with the ability to effectively deliver whatever message the end user desires.

(d) "Gun Graffiti" will allow the end user to get his/her point across to the public.

(e) "Gun Graffiti" will offer the highest level of customization available, including but not limited to color schemes and logo enhancements.

(f) "Gun Graffiti" will allow an inexpensive way for advertisers to advertise.

(g) "Gun Graffiti" will allow the end user to advertise with many different customers in a single day.

BRIEF DESCRIPTION OF THE DRAWINGS

FIG. 1 is a representation of a paint ball gun having a signage-bearing device around the barrel, according to the present disclosure.

FIG. 2 is a representation of a signage-bearing device as in FIG. 1.

DETAILED DESCRIPTION

A preferred embodiment of the "Gun Graffiti" placed on the nozzle of a paint ball gun is illustrated in FIG. 1 (side view). FIG. 1 shows a paint ball gun 1 with a paint ball gun barrel or nozzle 2. "Gun Graffiti" device 3, including an adhering mechanism 3*a* of material and signage 3*b*, is placed on barrel 2. FIG. 2 (ellipse view) generally shows device 3 of the present disclosure removed from gun 1. Signage 4 is placed in or on a logo placing area of device 3, which in the embodiment of FIG. 1 is shown as visually close to seam 5 of material adhering mechanism 1.

The disclosed device 3 may be manufactured with particular details according to a given manufacturing firm, such as by way of the most cost-effective method in the discretion of the firm. For example, device 3 may be manufactured out of a soft or soft-sided material, or of a material with soft-sided material connected or attached to it. It may be made of a material with elastic properties. Logos, names or other visual identification can be placed on the material in a variety of ways. For example, logos or names may be printed on the material, or placed or displayed on the material in other ways that such identification can be manufactured or placed onto materials.

Adhering mechanism 3*a* is a thin flat piece of material which, as can be seen from the drawings, is rolled up and attached to itself at seam 5. Thus, when unrolled prior to the attachment and creation of seam 5, adhering mechanism 3*a* in the illustrated embodiment is a substantially rectangular piece, having two opposing edges that are substantially longer than the remaining two opposing edges. Material at or adjacent the longer edges is attached together at seam 5, and seam 5 extends substantially parallel to barrel 2 when device 3 is placed on nozzle 2. The shorter edges of material 3*a* form the substantially circular ends of rolled device 3. As seen in the drawings, device 3 has an end that may be relatively near to but inboard of the end of barrel 2, so that it does not interfere with the end opening in barrel 2 through which a projectile exits. It is also seen in the drawings that the opposite end of the illustrated embodiment of device 3 remains away from the trigger and other operational parts of gun 1, and does not interfere with its operation.

Logos, words, names, or other visual identification are placed on device 3 in or on a logo placing area. In some embodiments, such visual identification is printed on the material in the logo placing area. As can be seen from the drawings, the logo placing area is preferably on one side of the material 3*a*, i.e. the side that is or will be outside when material 3*a* is rolled into a cylinder. Seam 5 is apart from the visual identification, and thus does not obstruct or interfere with the logo, name or other notation. As noted, various printing or affixation processes can be used to place such notations on the outside of and apart from the seam of material 3*a*.

Thus, as seen in FIG. 2 in one embodiment, the "Gun Graffiti" 1 is placed on paint ball gun nozzle 2 where logo placing area is located in material 3*a*. FIG. 2 illustrates "Gun Graffiti" 1 removed from paint ball gun nozzle 2, with the material adhering mechanism 3*a* is located on above the logo placing area 3 and apart from seam 5.

The manner of using "Gun Graffiti" when it is seamed at the manufacturing level is substantially as follows, in one embodiment. An end user places the elongated tube of device 3, which has a diameter greater than that of the elongated tube of barrel 2, over barrel 2. For example, one may place one end of the elongated tube of device 3 over the elongated tube of barrel 2, and sliding device 3 over the barrel to an unpredetermined but desired portion of the elongated tube of barrel 2. In embodiments as described above that have elastic properties, it will be seen that device 3 may be expanded as it is drawn over barrel 2, or an end of device 3 may be placed over barrel 2, and the other end of device 3 may be pushed so that the device is rolled over barrel 2.

From the description above a number of advantages of "Gun Graffiti" become evident:

(a) Will allow for more advertisement area within the paint ball industry (b) Will allow for athletes to stand out from the crowd and be unique.

(c) Provides all levels of markers with the ability to effectively deliver whatever message the end user desires.

(d) Will allow the end user to get his/her point across to the public.

(e) Will offer the highest level of customization available, including but not limited to color schemes and logo enhancements.

(f) Will allow an inexpensive way for advertisers to advertise.

(g) Will allow the end user to advertise with many different customers in a single day.

Accordingly, the reader will note that a "Gun Graffiti" device 3 of this disclosure can be used an indefinite number of times. The reader will further understand that the end user can maximize on profits from endorsements. The reader will still further see that a "Gun Graffiti" device 3 is easy to remove and replace with new "Gun Graffiti" with a different advertiser. The reader will further conclude that a "Gun Graffiti" device 3 can make person stand out from a crowd.

Although the description above has some specificities, these should not create bias as limiting the scope the new innovation but as a way of providing illustrations of some of the preferred embodiments.

I claim:

1. An apparatus, comprising:

a compressed air gun, said gun having a cylindrical barrel through which a projectile is propelled and a stock or grip rigidly connected to said barrel, wherein said barrel has a distal open end and a proximal end adjacent said stock or grip;

a sign surrounding said barrel inboard of said distal open end and not interfering with said distal open end or operation of said gun, said sign being a sheet having first and second edges joined by a seam, said sign being easily slidable onto said barrel over said distal open end, but not placeable over said stock or grip, said sign having one or more visual graphics visible when said sign is on said barrel.

2. The apparatus of claim 1, wherein said gun is a paintball gun.

3. The apparatus of claim 1, wherein the projectile is propelled by compressed gas.

4. The apparatus of claim 1, wherein said sheet is a rectangular piece of elastic material, said rectangular piece of material having two longer edges and two shorter edges, and said two longer edges are said first and second edges.

5. The apparatus of claim 1, wherein said sign fits snugly on said barrel, and said sign provides an extra thickness on said barrel so that overall diameter of said sign on said barrel is greater than the diameter of said barrel adjacent said distal open end.

6. The apparatus of claim 1, wherein said sheet and said visual graphics are fixed together prior to placement of said sign on said gun.

7. The apparatus of claim 1, wherein said visual graphics represent a sponsor of a user of said apparatus.

8. The apparatus of claim 1, wherein said visual graphics represent a team of a user of said apparatus.

9. A method, comprising:

providing the apparatus of claim 1, wherein said sign is a first sign;

removing said first sign from said barrel;

providing a second sign, said sign being a sheet having first and second edges joined by a seam, said sign having one or more visual graphics visible when said sign is on said barrel, said visual graphics of said second sign being different from said visual graphics of said first sign; and inserting said barrel through said second sign.

10. The method of claim 9, wherein said visual graphics of said first sign identify a first sponsor of said user of said gun, and said visual graphics of said second sign identify a second sponsor of said user of said gun that is different from said first sponsor.

11. The method of claim 10, wherein all of said steps are completed in one day.

12. A method, comprising:

providing a substantially rectangular sheet of material having elastic properties, said sheet having first and second edges that are parallel to each other, said sheet further having first and second sides between said edges;

printing visual information on said first side of said sheet, said visual information from the group consisting of team information, advertiser information and sponsor information;

rolling said sheet so that said first and second edges are adjacent each other and said first side is outward and said second side is inward;

attaching portions of said sheet to each other at or adjacent to said edges to form a substantially cylindrical device with a longitudinal seam at or adjacent to said edges; and placing said substantially cylindrical device around the barrel of a gun after said attaching, said barrel having an end opening for the exit of a projectile, so that said cylindrical device is inboard of the end opening and does not interfere with the end opening or operation of the gun.

13. An apparatus, comprising:

a compressed air gun, said gun having a barrel through which a projectile is propelled and a stock or grip, wherein said barrel has a distal open end and a proximal end adjacent said stock or grip;

a sign surrounding said barrel inboard of said distal open end and not interfering with said distal open end or operation of said gun, said sign being a sleeve movable onto said barrel over said distal open end, but not movable over said stock or grip, said sign having one or more visual graphics visible when said sign is on said barrel.

14. The apparatus of claim 13, wherein said sleeve is slidable onto said barrel over said distal open end.

15. The apparatus of claim 13, wherein said sleeve is rollable onto said barrel over said distal open end.

16. The apparatus of claim 13, wherein said gun is a paintball gun.

* * * * *

UNITED STATES PATENT AND TRADEMARK OFFICE

CERTIFICATE OF CORRECTION

PATENT NO. : 7,654,020 B2
APPLICATION NO. : 11/442730
DATED : February 2, 2010
INVENTOR(S) : Benjamin Lynn Frederick It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 351 days.

Signed and Sealed this

Twenty-eighth Day of December, 2010

David J. Kappos

David J. Kappos
*Director of the United States Patent and Trademark Office*